United States Patent [19]

Walsh

[11] Patent Number: 4,600,914

[45] Date of Patent: Jul. 15, 1986

[54] APPARATUS FOR DIRECTING ATTENTION TO SPECIFIC LOCATIONS SUCH AS EMERGENCY EXITS

[76] Inventor: James W. Walsh, 3823 Beech Ave., Baltimore, Md. 21211

[21] Appl. No.: 465,395

[22] Filed: Feb. 10, 1983

[51] Int. Cl.[4] ..... G08B 7/02; G08B 25/00

[52] U.S. Cl. ..... 340/286 R; 340/287; 340/815.21

[58] Field of Search ..... 340/286 R, 287, 815.21, 340/305; 179/18 BF, 99 P, 84 T

[56] References Cited

U.S. PATENT DOCUMENTS

| | | | |
|---|---|---|---|
| 3,969,720 | 7/1976 | Nishino | 340/815.21 |
| 4,151,514 | 4/1979 | Haynes | 340/286 R |
| 4,347,499 | 8/1982 | Burkman et al. | 340/286 R |

*Primary Examiner*—John W. Caldwell, Sr.
*Assistant Examiner*—Tyrone Queen
*Attorney, Agent, or Firm*—Millen & White

[57] ABSTRACT

Apparatus for identifying and directing attention to a location, such as an emergency exit, includes a series of sound generators arranged along a path leading from a remote site to the location. The sound generators are energized sequentially and individually, preferably with a tone which rises in frequency as the sound travels from the remote site to the location of interest. If the sound generators are used to direct attention to an emergency exit, the sound generators are activated upon the occurrence of an emergency condition, such as a fire, and the sequence of tones is cycled continuously until the emergency condition ceases.

9 Claims, 2 Drawing Figures

APPARATUS FOR DIRECTING ATTENTION TO SPECIFIC LOCATIONS SUCH AS EMERGENCY EXITS

BACKGROUND OF THE INVENTION

1. Field of the Invention

The instant invention relates to apparatus for directing attention to specific locations such as emergency exits. More particularly, the instant invention relates to apparatus for utilizing audible signals to direct attention to and identify locations such as emergency exits.

2. General Considerations and Prior Art

The traditional approach to identifying emergency exits in a building has been to utilize "EXIT" signs over exit doors. Typically, "EXIT" signs are illuminated by separate electrical circuits so as to remain lighted if electrical power in the building fails.

"EXIT" signs are generally placed high with respect to an emergency exit simply to render the signs visible to everyone in the room or hallway served by the exit. However, the effectiveness of the "EXIT" signs is compromised during a fire because smoke tends to accumulate down from the ceiling of the room or hallway. This, of course, tends to obscure "EXIT" signs. Safety experts encourage people to crawl beneath the smoke when trying to find the exit and warn people to count doors, so that they will know where the exit is. Although most of the smoke is near the ceiling, frequently there is still an accumulation of smoke near the floor, which is irritating and makes it difficult for people trying to escape to see. Consequently, the current effort to lower "EXIT" signs in buildings to locations nearer the floor does not necessarily improve the situation. Moreover, when signs are placed near the floor, they become subject to vandalism and may not be working when needed.

An approach to solving this problem is to use audible alarms near emergency exits so as to direct people to the exits by sound. But in a confusing situation, it is often difficult to determine exactly where a sound is coming from. Moreover, there is a tendency for people to avoid alarms simply because the usual audio alarm is identified with a fire and frequently causes people to move away from the alarm instead of towards it. Consequently, as an identifying device for an emergency exit, this type of alarm is not necessarily appropriate.

Accordingly, there is a need for a more effective way to both direct people's attention to emergency exits and to lead them to emergency exits regardless of the conditions in the room where the exits are located.

SUMMARY OF THE INVENTION

In view of the aforementioned considerations, it is a feature of the instant invention to provide new and improved apparatus for directing attention to locations such as emergency exits by utilizing audible signals.

In view of this feature, and other features, the instant invention contemplates apparatus for identifying a location and for directing attention to that location wherein the apparatus comprises a plurality of sound generators, including at least one generator positioned at the location to be identified and another generator positioned remote from that location. A circuit is provided for activating the sound generators individually, starting with that generator most remote from the location and ending with the generator at the location. Consequently, the sound moves toward the location directing attention to the location.

The apparatus further contemplates inclusion of circuitry for increasing the pitch of the sound as the sound moves from the remote generator toward the generator at the location to be identified. The instant invention is of specific interest for identifying emergency exits.

A method for identifying locations audibly in accordance with the methods of the instant invention comprises the steps of defining a path to the location with a plurality of sound generators spaced from one another and distributed along the path from a site remote from the location to the location. The sound generators are then individually activated momentarily, and in sequence, to move the sound toward the desired location. The sequence is cycled in order to continuously indicate the position of the location. The pitch emitted by each sound generator rises as the sound progresses toward the location. The method is particularly suitable for identifying emergency exits.

DESCRIPTION OF THE PREFERRED EMBODIMENT

Figure 1:
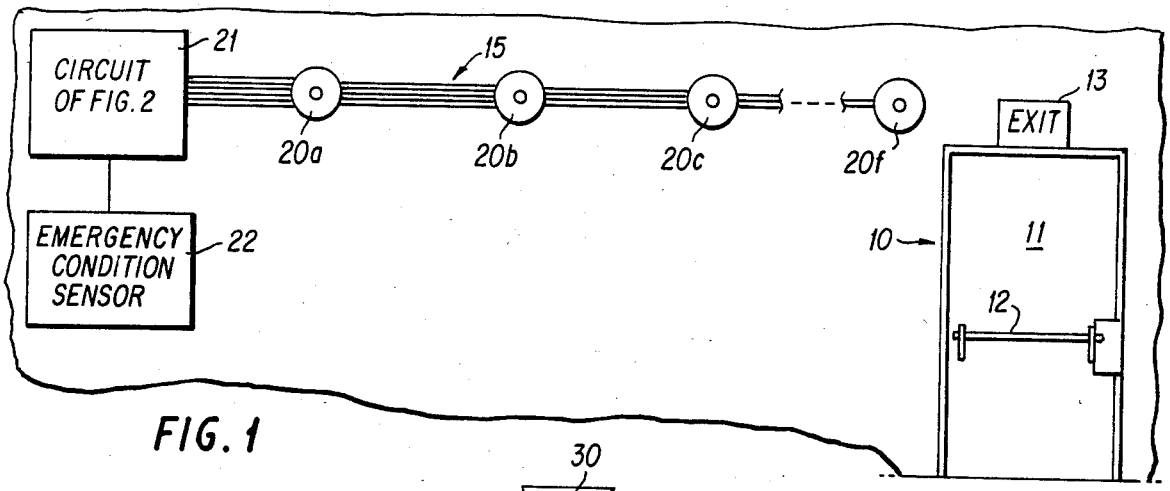
FIG. 1 is a schematic view showing a plurality of sound generators directing attention to an emergency exit in accordance with the teachings of the instant invention.

Referring now to FIG. 1, there is shown a wall 9 having an emergency exit, designated generally by the numeral 10, therethrough which includes an emergency exit door 11 which may be unlatched by a panic device 12 and is identified by an "EXIT" sign 13. In order to direct attention to the emergency exit 10, the apparatus of the instant invention, designated generally by the numeral 15, is mounted to define a path progressing from a site or location 16 remote from the exit 10 to a location 17 juxtaposed with the exit 10.

The apparatus 15 includes, in accordance with one embodiment, six speakers 20*a*–20*f*. While the particular embodiment shown shows six speakers, it should be kept in mind that any number of speakers may be utilized as long as there are a plurality of speakers. It is only necessary that the number be sufficient to direct attention toward the exit door.

The speakers 20*a*–20*f* are connected to a circuit, designated generally by the numeral 21, which sequentially activates the speakers individually and momentarily. Operation of the circuit 21 is initiated by an emergency condition detector 22 which can be, for example, a smoke detector, a pull box circuit or perhaps a heat sensor. In addition, the emergency condition sensor 22 can be connected to a central control panel and operated by a person monitoring the panel.

In accordance with one mode of operation, the sound generators 20*a*–20*f* are individually and momentarily energized by the circuit 21 in sequence so that the sound moves from 20*a* to 20*f*. It has been found that a sense of direction is created by raising the pitch of the sound as the sound progresses from sound generator 20*a* to sound generator 20*f*. Preferably, sound generator 20*f* is energized longer to indicate the end of the path and to audibly mark the emergency exit 10. After a short dwell, the sequence starts again and cycles until for one reason or another the detecting means 22 cuts power to circuit 21.

Figure 2:
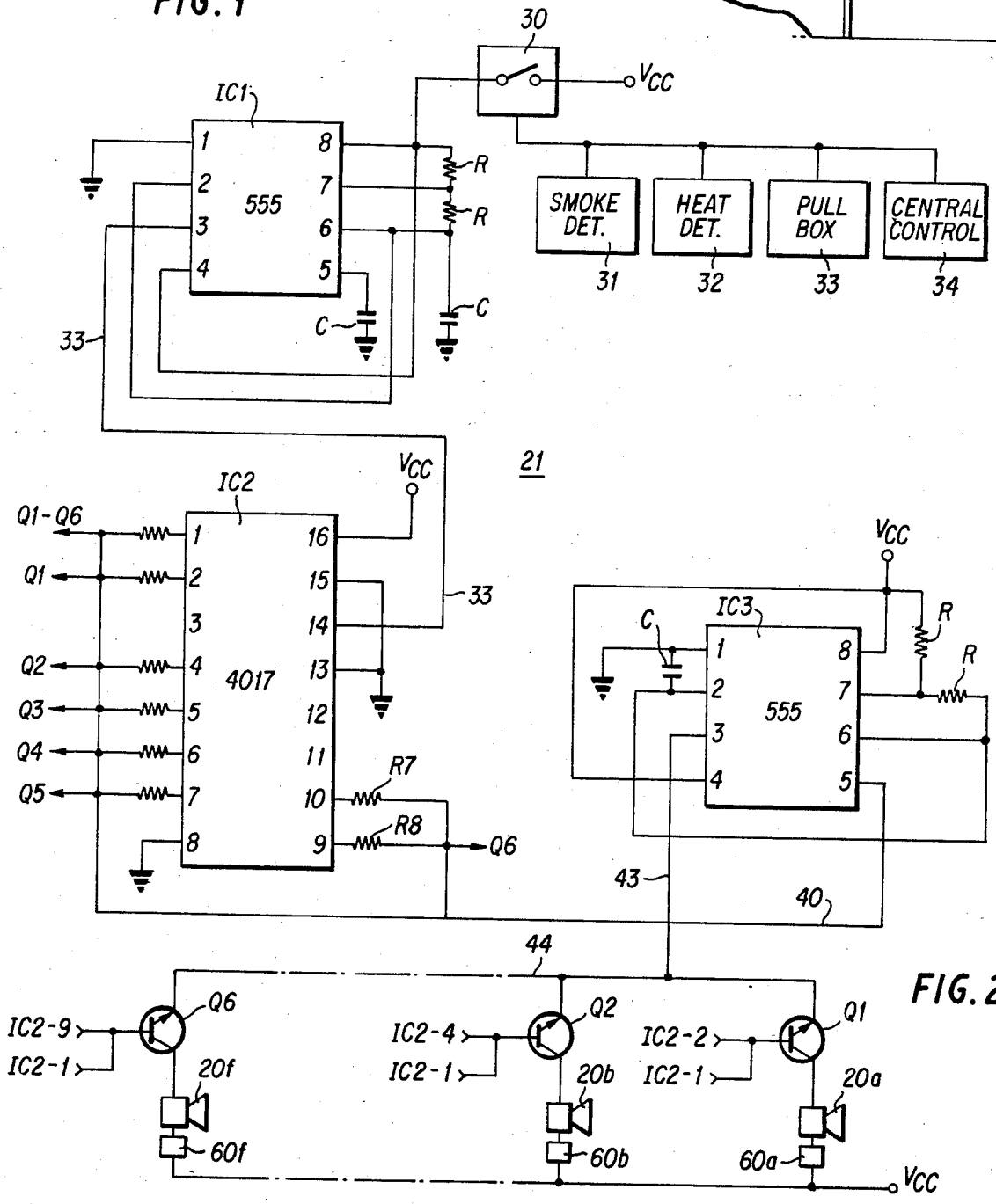
FIG. 2 is a circuit diagram showing circuitry for operating the sound generators of FIG. 1.

Referring now to FIG. 2, where a circuit diagram illustrates one embodiment of the invention in more detail, a switch 30 is operated by either a smoke detector 31, a heat detector 32, a pull box 33, or a central control station 34. Only one of the devices 31–34 need to utilized to close the switch 30. It is only necessary that some emergency detecting device start operation of the circuitry 21.

Upon closing the switch 30, line voltage Vcc is passed to pin 4 of clock IC1, which generates a clock frequency of approximately 1 hertz. In the illustrated example, Vcc is 60 hertz line current, but can be current from any source, such as an emergency, battery powered source. The 1 hertz signal from the clock IC1 is applied over line 33 to a pin 14 in a decade counter IC2. The decade counter IC2 sequentially enables output pins 2, 4, 5, 6, 7, and 9 in response to the 1 hertz signal from clock IC1. The outputs from these pins are applied to the bases of transistors Q1–Q6 to sequentially turn the transistors on momentarily in order to activate the speakers 20*a*–20*f*. The output from the pins of decade counter IC1 are also applied through resistors R1–R8 over line 40 to an audio tone generator IC3 by connection to pin 5 thereof. The audio tone generator IC3 is connected through pin 3 to a line 43 which is in turn connected to the emitters of transistors Q1–Q6 via common line 44. Accordingly, the frequency of the audio tone is determined by the value of programming resistors R1–R8.

The programming resistors R1–R8 are arranged so that a sequentially rising frequency occurs as the tone progresses from one speaker to the next. In order to provide a tone of longer duration than at other speakers, resistors R7 and R8 are combined. In order to provide a brief delay before starting each sequencing cycle, speaker 20*a* is activated upon pin 2 in decade counter IC2 going high so that there is a brief pause before the cycle starts again.

Appropriate frequencies determined by the programming resistors R1–R8 start at about two kilohertz at the unit furthest from the door 20*a* and increase to about four kilohertz at the unit 20*f* nearest the door.

If desired, lights 60*a*–60*f* can be wired in series with each speaker 20*a*–20*f* to flash concurrently with sounding of the speaker. This provides a moving light path which provides a visual indication of the exit location which compliments the audio path.

The foregoing disclosure is merely illustrative of the invention which is to be limited only by the following claims.

What is claimed is:

1. Apparatus for directing attention to a location, the apparatus comprising:

a plurality of sound generators each producing a sound having a pitch, the plurality of sound generators being arranged in an array wherein at least one sound generator is positioned at the location and another sound generator is positioned remote from the location;

activating means connected to the sound generators for individually activating the sound generators sequentially for a selected interval starting with the sound generator remote from the location and ending with the sound generator at the location; and pitch increasing means connected to the sound generators for sequentially increasing the pitch of the sound emitted by each sound generator as the sound generators are activated by the activating means, wherein attention is directed toward the sound generator at the location by a pattern of sound created by the activating and pitch increasing means.

2. The apparatus of claim 1 wherein the array of sound generators is arranged in series with the plurality including more than two sound generators.

3. The apparatus of claim 2 further including means for rendering the sound emitted by the generator at the location different from the sounds comprising the pattern of sounds emitted by the other sound generators.

4. The apparatus of claim 3 wherein the means for rendering the sound of the sound generator at the location different comprises means for lowering the pitch of the sound.

5. The apparatus of claim 4 further including means for recycling the pattern wherein the pattern is continuously repeated.

6. The apparatus of claim 4 further including a light located at each sound generator and means for energizing each light with activation of the sound generator.

7. The apparatus of claim 3 wherein the means for rendering the sound of the sound generator at the location different comprises means for prolonging the sound.

8. The apparatus of claim 5 wherein the location is an emergency exit and wherein the means for activating the sound generators sequentially includes means for indicating the occurrence of an emergency condition.

9. The apparatus of claim 8 wherein the activating means further includes: a switch connected to the indicating means for closure upon the occurrence of an emergency condition; a clock which is connected to the switch for initiating the pattern of sound; a counter which is connected to the sound generators and the clock for sequentially activating the sound generators, and an audio tone generator which is connected to the sound generators and counter for providing an audio frequency input to the sound generators and wherein the means for increasing the pitch of the sound are resistors of progressively increasing resistance connected between the counter and tone generator.

* * * * *